US006488274B1

(12) United States Patent
Hansch

(10) Patent No.: US 6,488,274 B1
(45) Date of Patent: Dec. 3, 2002

(54) APPARATUS FOR TRANSPORTING FLEXIBLE, SHEET-LIKE PRODUCTS

(75) Inventor: Egon Hansch, Wetzikon (CH)

(73) Assignee: Ferag AG, Hinwil (CH)

( * ) Notice: Subject to any disclaimer, the term of this patent is extended or adjusted under 35 U.S.C. 154(b) by 111 days.

(21) Appl. No.: 09/667,349

(22) Filed: Sep. 22, 2000

(30) Foreign Application Priority Data

Sep. 24, 1999 (CH) ..... 1753/99

(51) Int. Cl.[7] ..... B65H 5/00

(52) U.S. Cl. ..... 271/10.01; 271/11; 271/12; 271/95; 271/106

(58) Field of Search ..... 271/10.01, 11, 271/95, 106, 107, 12

(56) References Cited

U.S. PATENT DOCUMENTS

| | | | | |
|---|---|---|---|---|
| 3,720,409 A | * | 3/1973 | Kuboet al. | |
| 3,795,796 A | * | 3/1974 | Shigemori et al. | |
| 4,385,229 A | * | 5/1983 | Middleditch | 271/95 X |
| 6,015,145 A | * | 1/2000 | Hartel | 271/106 X |
| 6,101,787 A | * | 8/2000 | Brintazzoli et al. | 271/11 X |
| 6,193,229 B1 | * | 2/2001 | Hall et al. | 271/10.01 X |
| 6,279,894 B1 | * | 8/2001 | Steinberg | 271/12 |

FOREIGN PATENT DOCUMENTS

| | | |
|---|---|---|
| DE | 966 622 | 8/1957 |
| DE | 2 222126 | 11/1973 |
| DE | 42 20 398 A 1 | 12/1993 |
| GB | 2 303 844 A | 3/1997 |
| WO | WO 98/56705 | 12/1998 |

* cited by examiner

*Primary Examiner*—David H. Bollinger
(74) *Attorney, Agent, or Firm*—Brinks Hofer Gilson & Lione

(57) ABSTRACT

The apparatus serves for transporting flexible, sheet-like products, in particular printed products, from a stack, which is positioned at a receiving location, to a discharge location. The apparatus has a separating element as well as a supporting element and a retaining element, which, driven by a shaft, are respectively guided in a first and in a second path about the shaft such that products, which are retained by means of a force-fitting connection at the remote ends, as seen in the direction of rotation of the shaft, are gripped individually by the separating element at the end, located opposite said ends, and, with the top side oriented toward the shaft, can be raised into the region of the first path, where it is possible for them to have the supporting element running beneath them, to be aligned longitudinally in relation to the second path, with the underside oriented toward the shaft, and to be gripped there on the underside by the retaining element, to be released from the force-fitting connection, conveyed to the discharge location and transferred there to a further conveying apparatus.

18 Claims, 3 Drawing Sheets

Figure 1:
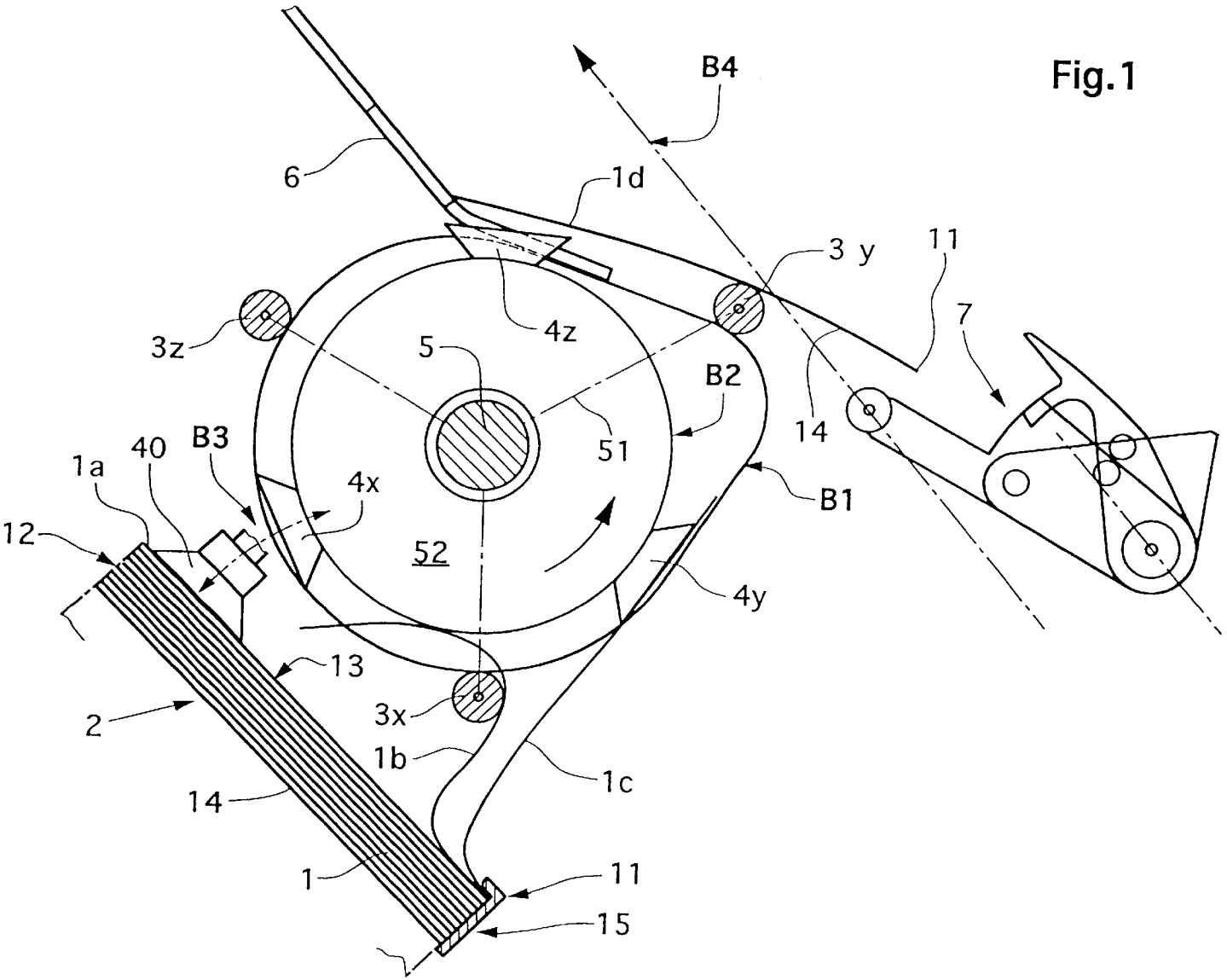

7
11
3 y
14
B1
B4
B2
4y
1d
51
4z
1c
11
15
5
52
3x
1b
4x
13
1
6
B3
14
3z
40
1a
2
12

APPARATUS FOR TRANSPORTING FLEXIBLE, SHEET-LIKE PRODUCTS

The invention relates to an apparatus for transporting flexible, sheet-like products, in particular printed products, from a stack, which is positioned at a receiving location, to a discharge location.

Such apparatuses are suitable for receiving stacked products individually by means of suction elements and grippers at a receiving location, conveying them to a discharge location and to pass [sic] them on there for further processing.

An apparatus of this type constitutes, for example, the subject matter of Swiss Patent Application No. 1999 0998/99. This apparatus has a circulatory wheel which is provided with a plurality of grippers and suction elements assigned to one another in pairs. During rotation of the circulatory wheel, in each case one individual product is raised from a stack by means of the suction elements, transferred to the associated gripper and then, supported by a following carrying arm of the suction element, conveyed to the discharge location.

The known apparatus is of large dimensions and is suitable, in particular, for transporting printed products, such as newspapers, periodicals and the like. The plurality of suction elements and grippers, which have to be controlled individually, result in a correspondingly high outlay for producing this apparatus.

The object of the invention is thus to provide a cost-effective apparatus which can be realized in small dimensions and by means of which flexible, sheet-like products, in particular relatively small and lightweight printed products, can be transported at a high conveying frequency from a stack, which is positioned at a receiving location, to a discharge location.

The apparatus according to the invention, which is intended for transporting flexible, sheet-like products, in particular printed products, from a receiving location to a discharge location, can be produced cost-effectively in smaller dimensions. Products, in particular those of reduced dimensions, can be transported at a higher cycle rate.

The increase in capacity results from an apparatus with retaining elements and supporting elements of reduced complexity and, at the same time, increased functionality, said elements moved about an axis. For the purpose of raising the stacked products off from the stack, use is made of a separating element which, rather than being moved about the axis, is moved in a simpler path. The separating element may be controlled with low outlay, with the result that it is possible to achieve an increased operating frequency and less likelihood of malfunctioning. The supporting elements, which serve for supporting and aligning products which are to be transported, are of straightforward construction and do not involve any control outlay.

Figure 2A:
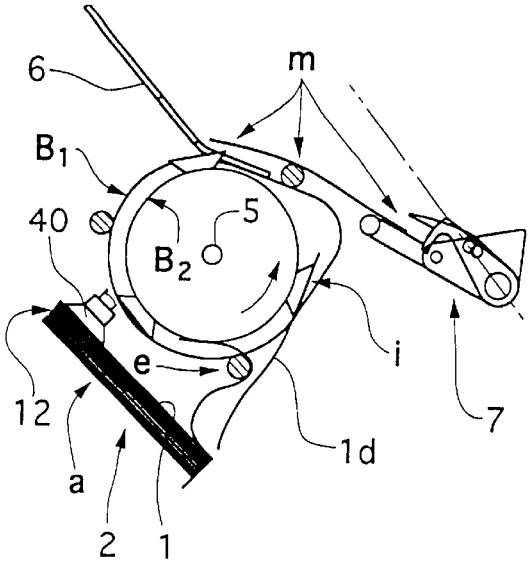
Figure 2B:
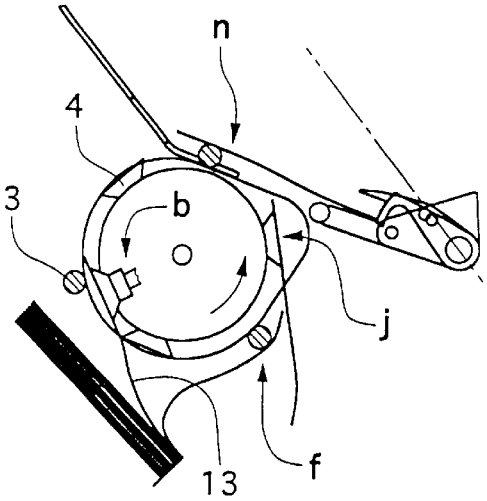
Figure 2C:
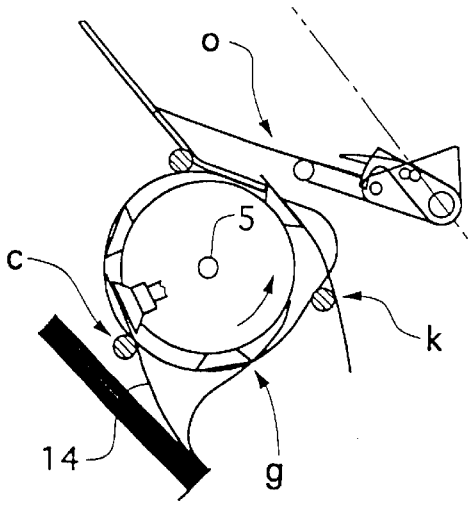
Figure 2D:
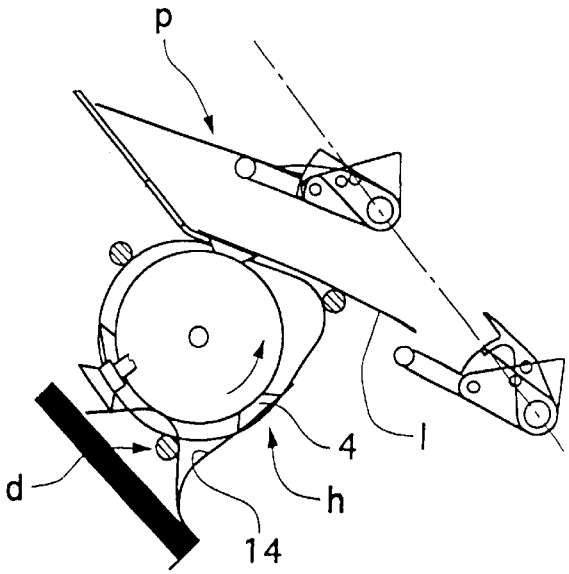
Figure 3:
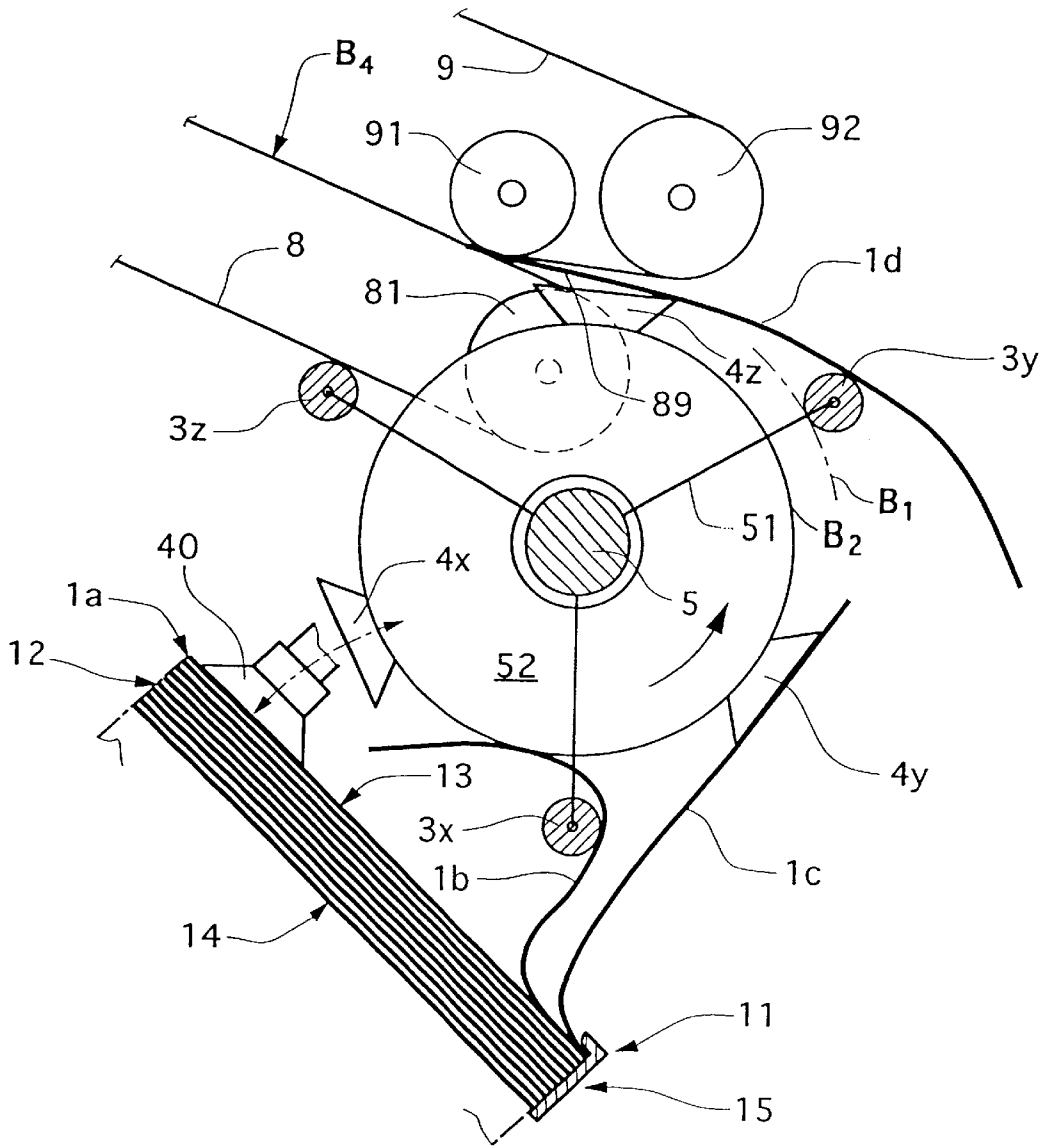

The invention is explained in more detail hereinbelow by way of exemplary embodiments, with reference to the drawing, in which:

FIG. 1 shows an apparatus according to the invention by means of which products mounted on a stack can be passed on, at a discharge location, to a transporting clamp;

FIGS. 2*a–d* show the apparatus according to FIG. 1 in different operating states; and FIG. 3 shows an apparatus according to the invention by means of which products mounted on a stack can be passed on, at a discharge location, to a belt conveyor.

FIG. 1 shows a side view of an apparatus according to the invention which serves for transporting flexible, sheet-like products 1, in particular printed products, from a stack 2, which is positioned at a receiving location, to a discharge location. The apparatus has a separating element 40 as well as three supporting elements 3*x*, 3*y*, 3*z* and three retaining elements 4*x*, 4*y*, 4*z*, which, driven by a shaft 5, are respectively guided in a first and in a second path B1; B2, at the same, preferably constant angular speed, about the axis of the shaft 5 and support and transport separated products 1*b*, 1*c*, 1*d*. The shaft 5 drives a circulatory wheel 52, on the circumference of which the retaining elements 4*x*, 4*y*, 4*z* are fastened at equal distances from one another.

The products 1 which are to be transported, and are mounted in a stack 2, are retained with a force fit at the first, leading edge 11, in relation to the direction of rotation of the circulatory wheel 52 and thus the direction of circulation of the supporting and retaining elements 3*x*, 3*y*, 3*z* and 4*x*, 4*y*, 4*z*, respectively, and are gripped individually, and raised, by the separating element 40, which is guided in a third path B3, in the border region of the second, trailing edge 12, in relation to the direction of rotation of the circulatory wheel 52. For the purpose of retaining the products 1 with a force fit at the first edge 11, it is possible, as shown in FIG. 1, to provide a retaining bracket 15 and/or an adhesive (for example post-it®) by means of which the border regions or the end sides of the first edges 11 are connected to one another.

The separating element 40, which is guided in the third path B3, is suitable for attaching by suction, or gripping, the stacked products 1; 1*a* in the exposed border region of the second edge 12. The third path B3 runs such that the second edge 12 of a product 1 can be raised into the region of the first path B1, in which the supporting elements 3*x*, 3*y*, 3*z* are guided, with the top side 13 oriented toward the shaft 5.

In order that the connecting location is not subjected to any tension as the products 1 are raised, the third path B3, in the region in which the separating element 40 secures the product 1, preferably runs along a segment of a circle, of which the center point is located in the region of the connecting location of the uppermost product la of the stack 2.

The first path B1, in which the supporting elements 3*x*, 3*y*, 3*z* are guided, and the second path B2, in which the retaining elements 4*x*, 4*y*, 4*z* are guided, run such that, as is described in more detail hereinbelow with reference to FIG. 2, it is possible for products 1 raised by the separating element 40 to have a supporting element 3 running beneath them, to be aligned tangentially to the second path B2, with the underside 14 oriented toward the shaft 5, and to be gripped there by a retaining element 4 on the underside 14, to be released from the stack 2, conveyed to the discharge location and discharged there. Following completion of the transporting operation, the originally trailing edge 12 of the product 1, as seen in the direction of rotation of the circulatory wheel 52, is the leading edge.

At the discharge location, the products 1 are conveyed by the retaining elements 4*x*, 4*y*, 4*z* to a set-down means 6 and released there, with the result that they can be gripped by a further conveying element, preferably a transporting clamp 7, for example at the first, trailing edge 11, and conveyed further along a fourth path B4. The set-down means 6 preferably has a ramp, by means of which products 1 transported, and released, by the retaining elements 4*x*, 4*y*, 4*z* are retained in the same position in each case, and are preferably supported in addition by associated supporting elements 3, with the result that they can always be gripped reliably by the transporting clamps 7.

The transfer at the discharge location may also be made to other types of conveyor. In a preferred configuration of the invention, the products 1 can be introduced by the retaining elements 4, at the discharge location, as shown in FIG. 3, into a conveying nip 89 of a belt conveyor which has two conveying belts 8, 9 which are respectively guided around deflecting rollers 81 as well as 91 and 92.

The product 1 introduced into the conveying nip 89 is transported away in an accelerated state in order to avoid collision with the following supporting element 3*y*. For the purpose of avoiding such a collision, it is also conceivable, instead of accelerating the product 1 gripped by the belt conveyor, to decelerate the following supporting element 3*y* or to force it inward in a controlled manner in the direction of the movement path B2, e.g. in the manner shown in FIG. 1.

The first path B1, like the second path B2, may basically run in the form of a circle. In the preferred configuration shown in FIG. 1, the first path B1, however, runs such that a product Id released from the force-fitting connection is supported by a following supporting element 3 on the underside 14, in the region of the first, in this case trailing edge 11 until the products 1 are discharged.

At the location at which the products 1 are gripped by the retaining elements 4*x*, 4*y*, 4*z* and/or at the locations at which the products 1 are released by the retaining elements 4*x*, 4*y*, 4*z*, the first path B1 preferably runs at least more or less tangentially to the second path B2, with the result that the products 1 are advantageously aligned during the receiving and transfer operations.

In order to realize a desired progression of the first path B1, the supporting element 3*x*, 3*y*, 3*z*, which are driven by the shaft 5, are mounted in a radially displaceable manner, for example, in guides 51, which are provided in the circulatory wheel 52, or by way of a linkage. The radial deflection of the supporting elements 3*x*, 3*y*, 3*z* along the first path B1 is preferably defined by a guidance means, along which the supporting elements 3*x*, 3*y*, 3*z* are guided, for example by means of radially inwardly directed spring force, as a function of the angle of rotation of the circulatory wheel 52. It is also possible to use cam mechanisms or cam control means as are known from Dubbel, Taschenbuch fur den Maschinenbau [Pocketbook for mechanical engineering], Springer-Verlag, Berlin 1990, 17th edition, pages G152–G155 and T38–T39.

The apparatus according to the invention and its functioning are described in more detail hereinbelow with reference to FIGS. 2*a* to 2*d*, which designate different positions a–p of the above-described supporting elements, retaining elements and separating elements 3, 4, 40. Use is made here of the designations specified in FIG. 1.

In FIG. 2*a*, position a, the uppermost product 1 of the stack 2 is gripped by the separating element 40 in the border region, at the second edge 12, and, as is shown in FIG. 2*b*, position b, with the top side 13 oriented toward the shaft 5, is raised into the region of the first path B1.

In this position, as is shown in FIG. 2*b*, position b and FIG. 2*c*, position c, the second edge 12 of the product 1 has a supporting element 3 running beneath it. The product 1 is then aligned longitudinally in relation to the second path B2, with the underside 14 oriented toward the shaft 5 (FIG. 2*d*, position d, FIG. 2*a*, position e and FIG. 2*b*, position f).

The aligned product 1 (FIG. 1, product 1*c*) is then gripped by a following retaining element 4 on the underside 14, in the border region of the second edge 12 (FIG. 2*c*, position g and FIG. 2*d*, position h). In this position, the product 1; 1*c* is still retained with a force fit in the region of the first edge 12. It is only during continued rotation of the shaft 5 that the product 1; 1*c* is released from the above-described force-fitting connection (FIG. 2*a*, position i) and conveyed further (FIG. 2*b*, position j).

In a further phase, the detached product 1; Id is supported on the underside 14, in the region of the first, trailing edge 11, by the following supporting element 3, which aligns, or has aligned, the following product 1, preferably until the product 1 is discharged (FIG. 2*c*, position k and FIG. 2*d*, position 1).

FIG. 2*a*, position m and FIG. 2*b*, position n show the transfer of the product 1; 1*d* which has been released by the retaining element 4, but is still supported, to the set-down means 6 and/or the transporting clamp 7.

FIG. 2*c*, position o and FIG. 2*d*, position p show the product 1; 1*d* gripped by the transporting clamp 7 being transported further.

The different functions by way of which a product 1 can be reliably detached from the stack 2 and transported to the discharge location may be performed at high speed by supporting elements, retaining elements and separating elements 3, 4, 40 in a straightforward construction, this resulting in a high transporting capacity for the apparatus. The supporting elements 3*x*, 3*y*, 3*z*, which may be configured as rods or profiled bars, do not require any further control functions in addition to the guidance in the first path B1, this resulting in low production and control outlay. The elimination of control functions and the simplified transporting sequence, in turn, contributes to increasing the transporting capacity.

The retaining elements 4*x*, 4*y*, 4*z*, which may be designed as suction elements or grippers, can be controlled as a function of the angle of rotation of the shaft 5 such that, approximately between the positions h to 1 shown in FIG. 2, air and the relevant product 1; 1*d* are respectively taken in and attached by suction and a gripping function is initiated. The retaining elements 4*x*, 4*y*, 4*z* are thus likewise easily constructed and controlled with low outlay.

The separating element 40 may likewise be configured as a suction element or gripper.

The drive for the shaft 5 and the drive of the separating element 40 (if a separate drive is provided) are arranged such that they are displaced with respect to one another preferably axially in relation to the shaft 5. The drive for the shaft 5 may be arranged, for example, behind the circulatory wheel 52 (thus not illustrated in the drawing), while the drive of the separating element 40 is arranged in front of the circulatory wheel 52.

In order for the entire capacity of the apparatus to be utilized in full, it is possible to optimize the number of supporting elements, retaining elements and separating elements 3, 4, 40 used, with account being taken of the dimensions and the mass of the products 1 which are to be transported.

It can be seen from FIG. 1 that it would also be possible for the retaining element 4*x*, and thus also the other retaining elements 4*y*, 4*z*, to be lowered along the third path B3. Instead of the above-described separating element 40, it would thus also be possible to use the retaining elements 4*x*, 4*y*, 4*z* for gripping and raising products 1. For this case, the progression of the retaining elements 4*x*, 4*y*, 4*z* in the second path B2 is supplemented by an additional deflection in the third path B3. These measures make it possible to dispense with a separate separating element 40. However, this additional function of the retaining elements 4*x*, 4*y*, 4*z*, which increases the control outlay, limits the conveying capacity since a relatively large amount of time is required for the lowering and raising operations. In addition, the second path B2 has a less favorable progression.

The products 1 are preferably relatively lightweight printed products, for example notes in the manner of post-it® products, or content-filled trade samples.

The apparatuses shown in FIGS. 1–3 are preferably configurations of the invention in which the supporting elements 3 and the retaining elements 4 are guided in a manner in which they are driven by a shaft 5 about an axis, the axis of the shaft 5. Instead of a shaft drive, it is also possible to use another drive, e.g. a chain drive, by means of which the supporting elements 3 and the retaining elements 4 are guided synchronously about an axis.

What is claimed is:

1. An apparatus for transporting flexible, sheet-like products, in particular printed products, from a stack of such products which is positioned at a product receiving location to a product discharge location, the apparatus comprising:

a supporting element and a retaining element mounted for circulation travel about an axis in a first path and a second path, respectively, said paths extending over the upper most product in the stack of sheet-like products from the trailing edge to the leading edge of said uppermost product;

a separating element which grips the upper side of said uppermost product adjacent its trailing edge and, while said leading edge is restrained against movement, raises said product from its trailing edge into said first path whereby said supporting element travels beneath it and moves said product into longitudinal alignment with said second path and with its underside facing said axis;

said retaining element then gripping said product on its underside and conveying said product to said discharge location.

2. The apparatus as claimed in claim 1, wherein the retaining elements are arranged at uniform intervals one behind the other on a circulatory wheel which rotates about the axis.

3. The apparatus as claimed in claim 2, wherein the supporting elements are mounted in a radially displaceable manner, such that they are spaced apart from one another at the same angles as the retaining elements, in relation to the axis, and are guided in the first path by a guidance means or a cam control means.

4. The apparatus as claimed in claim 3, wherein the first path runs such that the product gripped by a retaining element is supported on the underside, in the region of the first, trailing edge, by a following support element.

5. The apparatus as claimed in claim 4, wherein, in the region in which the retaining elements grip the products and/or in the region of the discharge location, the first path runs at least more or less tangentially to the second path.

6. The apparatus as claimed in claim 1, wherein the first path runs such that the product gripped by a retaining element is supported on the underside, in the region of the first, trailing edge, by a following supporting element.

7. The apparatus as claimed in claim 6, wherein, in the region in which the retaining elements grip the products and/or in the region of the discharge location, the first path runs substantially tangentially to the second path.

8. The apparatus as claimed in claim 7, wherein the separating element is guided substantially along a segment of a circle, which center point is located in the region in which the uppermost product is retained with a force fit.

9. The apparatus as claimed in claim 8, wherein the retaining elements and the separating element are configured as at least one of suction elements or grippers and are suitable for attaching the products by at least one of suction or gripping.

10. The apparatus as claimed in claim 1, wherein the products can be discharged by the retaining elements, at the discharge location, in a set-down means which is preferably in the form of a ramp, at which location they are gripped by a transporting clamp, preferably in the region of the first, trailing edge, and conveyed further.

11. The apparatus as claimed in claim 1, wherein the products can be introduced by the retaining elements, at the discharge location, into the conveying nip of a belt conveyor.

12. The apparatus as claimed in claim 1, wherein the supporting elements are rods or bars which are preferably aligned parallel to the axis.

13. The apparatus as claimed in claim 1, wherein the supporting elements and the retaining elements are guided continuously and/or at the same angular speed.

14. The apparatus as claimed in claim 1, wherein the supporting elements are mounted in a radially displaceable manner, such that they are spaced apart from one another at the same angles as the retaining elements, in relation to the axis, and are guided for travel in the first path by guidance means.

15. The apparatus as claimed in claim 1, wherein the supporting elements are mounted in a radially displaceable manner, such that they are spaced apart from one another at the same angles as the retaining elements, in relation to the axis, and are guided for travel in the first path by cam control means.

16. The apparatus as claimed in claim 1 wherein, in the region of the first edges the products are connected to one another on the end sides by at least one of an adhesive or pressure applied by a mechanical device.

17. The apparatus as claimed in claim 1 wherein, in the region of the first edges, the products are connected to one another over substantially their entire surface area by at least one of an adhesive or pressure applied by a mechanical device.

18. The apparatus as claimed in claim 1, wherein the retaining elements and the separating element are configured as at least one of suction elements or grippers and are suitable for attaching the products by at least one of suction or gripping.

* * * * *